United States Patent [19]

Crain

[11] 4,450,905

[45] May 29, 1984

[54] MUD BUCKET

[76] Inventor: Scott L. Crain, R.R. 1, Morrowville, Kans. 66958

[21] Appl. No.: 406,165

[22] Filed: Aug. 9, 1982

[51] Int. Cl.[3] ..... E21B 19/00

[52] U.S. Cl. ..... 166/85; 175/209; 166/81

[58] Field of Search ..... 166/85, 81; 285/13, 285/14, 419, 373, 320, 325, 326; 175/209; 24/263 CA, 263 B, 263 D; 403/344; 81/57.2

[56] References Cited

U.S. PATENT DOCUMENTS

| | | | |
|---|---|---|---|
| 551,464 | 12/1895 | Elliott | 255/50 |
| 551,465 | 12/1895 | Elliott | 255/50 |
| 796,327 | 8/1905 | Hardsocg | 255/50 |
| 1,481,158 | 1/1924 | Smith | 81/57.2 X |
| 1,542,776 | 6/1925 | Ingram | 166/16 |
| 1,969,513 | 8/1934 | Kelley | 255/50 |
| 1,972,846 | 9/1934 | Kelley | 255/50 |
| 2,096,882 | 10/1937 | Chernosky | 166/81 |
| 2,214,428 | 9/1940 | Miller | 166/81 |
| 2,329,461 | 9/1943 | Flynn | 166/162 |
| 2,353,412 | 7/1944 | Miller | 166/81 |
| 2,605,083 | 7/1952 | Collins | 255/24 |
| 2,730,333 | 1/1956 | Lenhart, Jr. et al. | 255/50 |
| 3,196,717 | 7/1965 | Sheppard | 81/57.2 |
| 3,738,436 | 6/1973 | Litchfield et al. | 175/65 |
| 3,847,372 | 11/1974 | Litchfield | 251/248 |
| 4,276,945 | 7/1981 | Ward, Sr. | 175/209 |

*Primary Examiner*—James A. Leppink
*Assistant Examiner*—Michael Starinsky
*Attorney, Agent, or Firm*—Henderson & Sturm

[57] ABSTRACT

Apparatus for use in conjunction with a drilling rig for catching and saving mud or the like from inside of a drilling rig pipe or drill string, comprised of one to three sections of pipe or stands connected together at connection junctures, of the type having a drill bit at the bottom thereof for use when the drill string is in the process of being pulled up out of a hole drilled in the ground. When each topmost stand of pipe is disconnected from the adjacent lower stand of pipe at a connection juncture, one stand of pipe is disconnected from the adjacent lower stand of pipe at the topmost connection juncture. A pair of doors are provided on one side on the container for opening the container on one side. A closing mechanism is attached to the container for automatically closing the container when the container is positioned at one side thereof against the pipe whereby the force of the closing mechanism against the pipe will cause the container to close. A latch is attached to the other side of the container for locking the container in a closed position in sealing engagement with the pipe around the topmost connection juncture. A drain is disposed in the lower part of the container for emptying mud from the container after the topmost stand of pipe has been disconnected.

9 Claims, 11 Drawing Figures

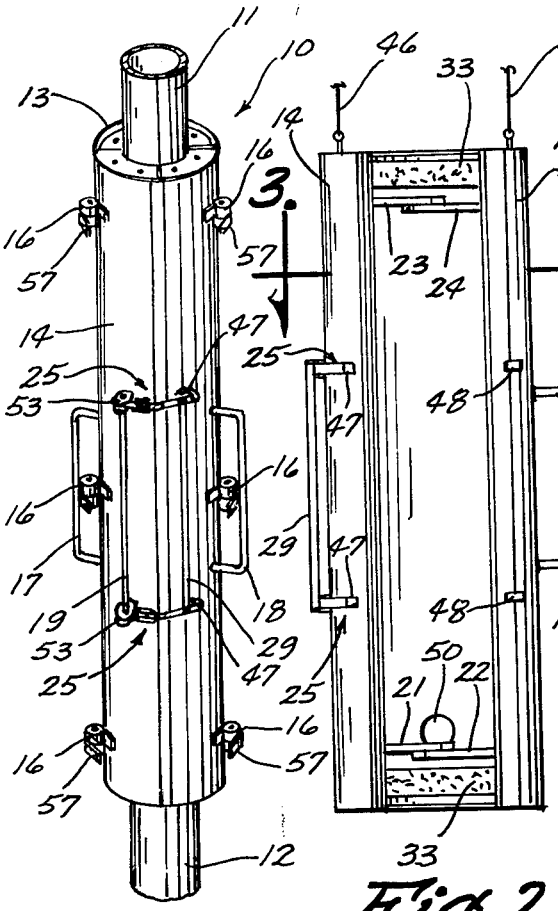
Fig. 1
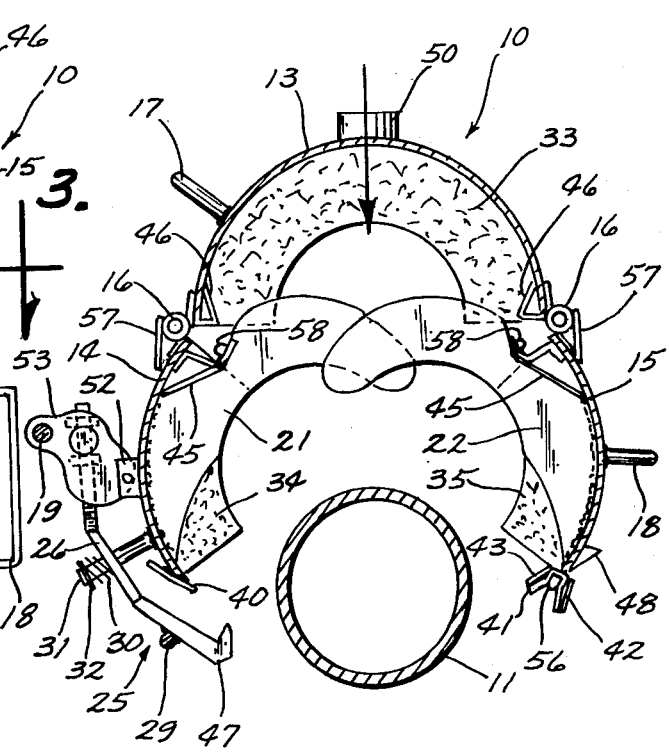
Fig. 2
Fig. 3
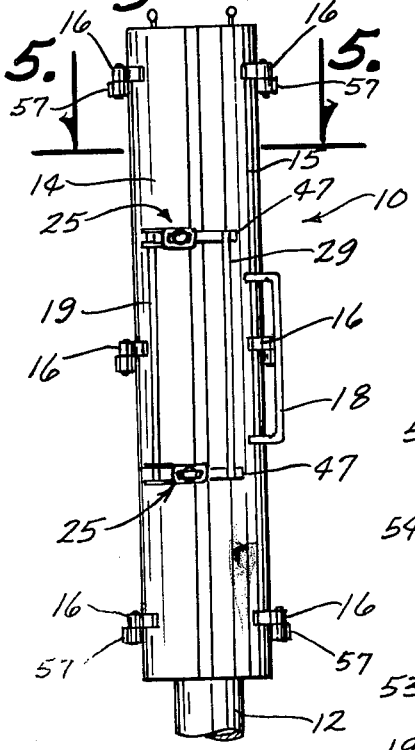
Fig. 4
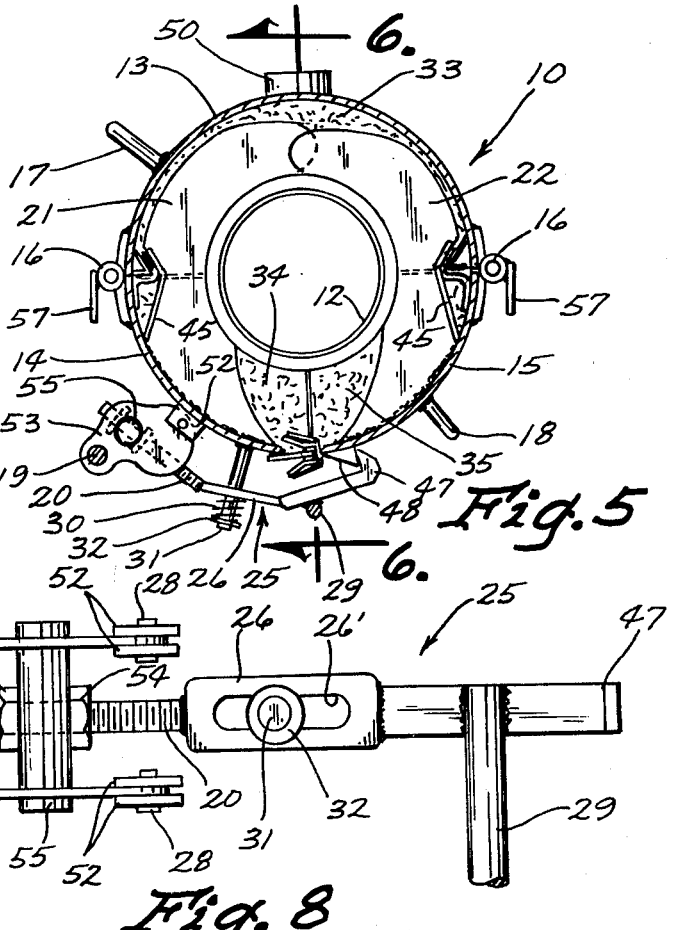
Fig. 5
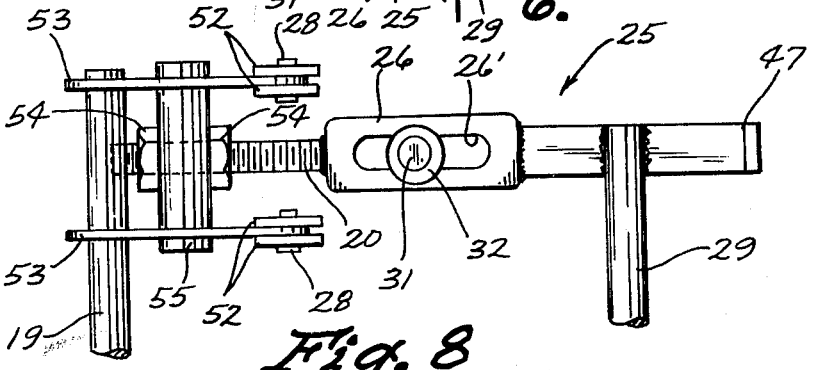
Fig. 8

MUD BUCKET

BACKGROUND OF THE INVENTION

The present invention relates generally to an apparatus for well drilling rigs or the like and more particularly to an apparatus for containing the liquid such as mud or the like when such well drilling rig is being pulled and stands of such pipe are being removed.

During the process of drilling for oil or the like, a drill string pipe is connected to a derrick and has a drill bit at the bottom end thereof. The drill bit is rotated from above and a liquid substance such as the earth being drilled away combined with a mixture of chemicals forms a mud-like substance within such pipe. The purpose of the mud is to have a liquid thick enough that the viscosity is far below water, thus the cuttings at the bottom of the hole will float in the drilling mud.

During an oil drilling operation, as the drill goes deeper into the ground, sections of pipe are connected to the top end of such pipe thereby accomodating the additional depth of drilling process. Periodically, it becomes necessary to pull the entire drill string pipe out of the ground, for example for the purpose of changing bits. When the string, consisting of many sections of pipe connected together at connection junctures, is pulled up for the purpose of changing bits or the like, the topmost stand of pipe is disconnected from the one immediately below it and this process is continued until the entire pipe has been pulled up, one stand at a time. Because each stand of pipe is full of mud or the like, when such top section of pipe is disconnected from the stand of pipe immediately below it, the mud in the upper stand of pipe will drain out upon such disconnection. Consequently, it is necessary to contain the mud as each stand of pipe is disconnected. Furthermore, it is desirable to save this liquid substance such that after the bit is changed and the drill string pipe is lowered back down into the ground and each of the stands of pipe are connected, in inverse fashion with respect to the above described pulling process, it is desirable to reintroduce the mud back into the pipe rather than to generate this substance again.

Consequently, there has developed in the art a device commonly referred to as a "mud guard" or "mud bucket" for the purpose of catching the mud from the topmost stand of pipe when it is being removed. In the prior art such devices consisted of basically a cylindrical container having a hinge on one side thereof which is clamped around the joint between the topmost stand of pipe and the stand of pipe immediately below it to catch the mud when the topmost stand of pipe is disconnected. Such prior devices are manually clamped around and manually latched to maintain it in a closed, sealed position during this process.

The above identified prior art process is often difficult, time comsuming and not altogether dependable when such prior art devices are used. Of necessity, these prior art devices are heavy and bulky and it is very time consuming to get the proper alignment with respect to the pipe to get such device closed and opened as needed. Consequently, there has developed a need for a device of the type described above which can more efficiently be used.

SUMMARY OF THE INVENTION

The present invention relates to an apparatus for use in conjunction with a drilling rig for catching and saving mud or the like from inside of a drill string, comprised of stands of pipe connected together at connection junctures, of the type having a drill bit at the bottom thereof for use when the string is in process of being pulled up out of a hole drilled in the ground. When each topmost stand of pipe is disconnected from the adjacent lower stand of pipe at a connection juncture, one stand at a time during the pulling process, a container is disposed around the topmost connection juncture for catching mud or the like when the topmost stand of pipe is disconnected from the adjacent lower stand of pipe at the topmost connection juncture. A pair of doors are provided on one side of the container for opening the container on one side. A closing mechanism is attached to the container for automatically closing the container when the container is positioned at one side thereof against the pipe whereby the force of the closing mechanism against the pipe will cause the container to close. A latch is attached to the other side of the container for locking the container in a closed position in sealing engagement with the pipe around the topmost connection juncture. A drain is disposed in the lower part of the container for emptying mud from the container after the topmost stand of pipe has been disconnected.

An object of the present invention is to provide an improved apparatus for catching the liquid within an oil drilling rig during the process of pulling the pipe in such rig.

Another object of the invention is to provide an apparatus for catching the liquid within a topmost stand of pipe of an oil drilling pipe which is being removed during the process of pulling the pipe from the ground.

A further object of the invention is to provide an apparatus of the type described above which automatically closes around such pipe and automatically latches.

Still another object of the invention is to provide an apparatus of the type described above which is economical to construct and dependable to use.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective view of the present invention shown clamped around a drilling pipe;

FIG. 2 is a side elevational view of the present invention shown in an open position thereof;

FIG. 3 is a cross-sectional view taken along line 3—3 of FIG. 2;

FIG. 4 is a side elevational view of the present invention shown in a closed position thereof with the topmost pipe stand removed;

FIG. 5 is a cross-sectional view taken along line 5—5 of FIG. 4;

FIG. 8 is an enlarged, detailed view of the latch mechanism of the present invention;

DETAILED DESCRIPTION OF THE PREFERRED EMBODIMENT

Figures 6, 7, 9, 10, 11:
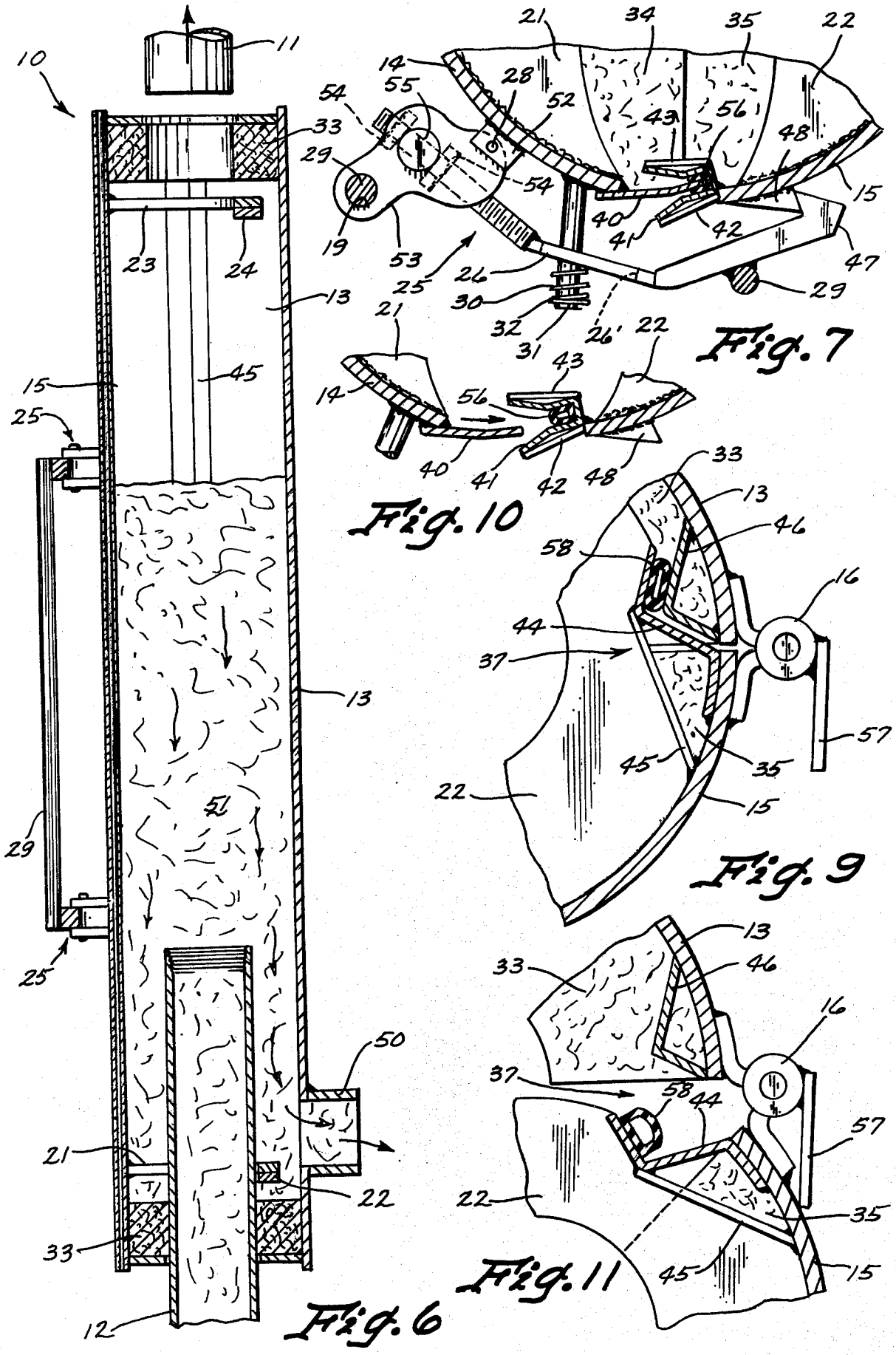
FIG. 6 is a cross-sectional view taken along line 6—6 of FIG. 5.
FIG. 7 is an enlarged, detailed view of the latch and seal structure of the present invention.
FIG. 9 is an enlarged, detailed view of the hinge portion of the apparatus and the sealing structure associated therewith in the closed portion thereof.
FIG. 10 is a view like FIG. 7 but showing in the apparatus in a partially open position.
FIG. 11 is a view like FIG. 9, but showing the apparatus partially open corresponding to FIG. 10.

Referring now to the drawings wherein like reference numerals designate identical parts through the several views, FIG. 1 shows the present invention 10 clamped around a juncture between a topmost pipe 11 and a pipe 12, which is connected to the bottom of pipe 11. The apparatus 10 includes a first portion 13 which is essentially half of a cylinder in the embodiment shown, and second and third portions 14 and 15, which are essentially one-quarter of a cylinder. The second and third portions 14 and 15 are hingedly connected to the first portion 13 by means of a plurality of hinges 16. A handle 17 is connected to the first portion 13 and a handle 18 is connected to the third portion 15 for handling the apparatus 10 and facilitating the opening of the device when necessary as will be described further below.

A first arm member 21 is welded to the interior of the second section 14, as can be readily seen in FIGS. 3 and 5, and a second arm member 22 is, in like fashion, welded to the interior of the third portion 15 of the apparatus 10. These arm members 21 and 22 are disposed near the bottom of the apparatus 10 as can be seen in FIG. 2, and similar third and fourth arm members 23 and 24 are respectively attached to portions 14 and 15 at the top thereof.

Latches 25 are connected to the second portion 14 and such latches 25 include members 26 which are pivotally connected to the portion 14 by means of an ear 52 and a pivot pin 28. Each of these levers 26 is connected together by means of handles 19 and 29 so that they move simultaneously with each other. Furthermore, the latches 25 are biased to the position shown in FIGS. 3 and 5 by means of a compression spring 30 disposed on a bolt 32. Such bolt 31 is rigidly connected at one end thereof to the portion 14 and extends through a slot 26' in the middle of the member 26. A fastener structure 32 prevents the member 26 from pivoting upwardly too far in the counterclockwise direction as viewed in FIGS. 3 and 5. Nut member 54 connected to threaded member 20 allow easy adjustment of end 47 with regard to member 48.

A sealing member 33 is bolted to the bottom of the portion 13 of the container, for example as shown in FIGS. 2, 3 and 5, and an identical seal 33 is bolted to the top of the member 13 as can be readily seen in FIG. 2. Similar, but smaller, seals 34 and 35 are connected to the portions 14 and 15, respectively, of the container at the top and bottom thereof such that when the apparatus 10 is clamped around pipes 11 and 12, the liquid drained from the pipe 11 will be contained within such apparatus 10.

Referring now to FIGS. 7–11, longitudinal seal assemblies 36 and 37 are shown in detail. The seal 36 seals the edges of the portions 14 and 15 which come open at seal 56. A plate 40 is welded to the portion 14 of the container, and this plate 40 is received into a groove, having seal 56 disposed therein, formed by a U-shaped elongated member 41, which is rigidly attached to the portion 15 of the container 10 by means of support braces 42 and 43. A stop member 57 (FIG. 11) prevents the doors 14 and 15 from opening too far.

Turning now to FIGS. 9 and 11, the seal 37 is comprised of a plate member 44 which is welded to respective are members 21–24 near the ends thereof and along its length to the portions 14 or 15, FIGS. 9 and 11 showing only portion 15 of the container 10. An alignment member 45 is welded to the seal plate member 44, and this member 45 cooperates with a similarly shaped member 46, which is welded along its length at each end thereof to the first portion 13 of the container 10. Elongated seal 58 is glued to member 44 and extends along the entire length of member 44.

In operation, when it is desired to pull the pipe or "drill string" on an oil rig, the topmost stand of the pipe 11 is pulled upwardly thereby pulling up the stand (which may include up to three lengths of pipe) of the pipe 12 and all other stands below it upwardly at the same time. Once the juncture connecting the topmost pipe 11 and the pipe 12 immediately therebelow is in a proper position, the apparatus 10, which is suspended from an oil derrick by means of cables 47 as shown in FIG. 2, is swung into position adjacent to the pipes 11 and 12, for example as shown in FIG. 3. As the pipe stands 11 and 12 contact the ends of the arm members 21–24 as the apparatus 10 is swung against such pipes 11 and 12, the force of such arm members 21–24 against the pipes 11 and 12 will cause the portions 14 and 15 to pivot inwardly around the pipe until they move to the position shown in FIG. 5. As such sections 14 and 15 move towards the closed position as shown in FIG. 5, the ends 47 of the latch members 26 will move up over the projections 48 on the portion 15 of the container, against the resistance of the spring 30. Once such ends 47 have passed the projections 48, the spring 30 will cause them to latch over the top of the projections 48 to the latched position shown in FIG. 5. Once this is done, then the topmost pipe 11 can be rotated so that it is disconnected from the threads of the lowermost pipe 12, and such upper pipe 11 can be withdrawn through the top of the apparatus 10.

A cap (not shown) is normally disposed over the drainage opening pipe 50 as shown in FIG. 6, and FIG. 6 shows the mud 51 being drained from such drainage pipe 50 into a container to be saved and reused.

Referring again to FIG. 6, after all of the mud 51 has been drained from the apparatus 10, then the handle 29 on the latches 25 will be pulled outwardly to unlatch the apparatus 10, and handles 17 and 18 can be used in conjunction with the handle 29 to pull the device back to the position shown in FIGS. 2 and 3 whereby the apparatus 10 can be swung away from the pipe 12. The process is then repeated with the next "joint" or stand of pipe by pulling up the stand of pipe 12 until the pipe 12 will be the topmost pipe and is then disconnected from the stand of pipe immediately below it, while at the same time using the apparatus 10 to contain and save the liquid therein.

Obviously, many modifications and variations of the present invention are possible in light of the above teachings. It is therefore to be understood that, within the scope of the appended claims, the invention may be practiced otherwise then as specifically described.

I claim:

1. Apparatus for use in conjunction with a drilling rig for catching and saving mud or the like from inside of a drilling rig pipe of the type having a drill bit at the bottom thereof and a plurality of stands of pipe connected together by connection junctures, for use when the pipe is in the process of being pulled up out of a hole in the ground and when each topmost stand of pipe is disconnected from the adjacent lower stand of pipe at a connection juncture, one stand at a time during the pulling process, said apparatus comprising:

container means for forming a container around the topmost connection juncture for catching mud or the like when the topmost stand of pipe is disconnected from the adjacent lower stand of pipe at said topmost connection juncture;

a pair of hinge means connected to a first portion of said container means and to one side of second and third portions of said container means and being disposed along parallel axes which are also parallel to the longitudinal axis of said pipe for selectively permitting pivoting of said second and third portions of the container means outwardly away from each other;

closing means attached to said container means for automatically closing said container means when said container means is positioned at said one side thereof against said pipe whereby the force of said closing means against said pipe will cause said container means to close, said closing means including a first arm means attached to said second portion of said container means and extending inwardly of said container for contact with said pipe, and whereby movement of said first arm means against said pipe when said second portion of said container means is in the open position thereof causes said second portion of said container means to move toward the closed position thereof and a second arm means attached to said third portion of said container means for contact with said pipe and whereby movement of said second arm means against said pipe when said third portion of said container means is in the open position thereof causes said third portion of said container means to move toward said closed position thereof;

latch means attached to the other side of said second and third portions of said container means for locking said container means in a closed position in sealing engagement with said pipe around said topmost connection juncture, said latch means including means for automatically latching said container means in a closed position when said container means moves to said closed position, and including means for selectively unlocking said latch means, whereby said container means can be opened after it has been drained for use on the next connection juncture to be disconnected; and drain means for emptying mud from said container means after said topmost pipe has been disconnected.

2. The apparatus of claim 1 including seal means for sealing the second and third portions of said container means together when both are in the closed position thereof whereby mud does not leak between said second and third portions.

3. The apparatus of claim 2 including bottom seal means at the bottom of said first, second and third portions of said container means for preventing mud from leaking out of the bottom of said container means when said container means is closed around said pipe.

4. The apparatus of claim 1 including handle means connected to the outside of at least two of said first, second and third portions of said container means for facilitating the opening of said container means in conjunction with said latch means.

5. The apparatus of claim 1 wherein said first and second arm means are disposed adjacent one end of said container means and further comprising:

a third arm means attached to said second portion of said container means and extending inwardly of said container for contact with said pipe and whereby movement of said third arm means against said pipe when said second portion of said container means is in the open position thereof tends to move said second portion of said container means towards said closed position thereof;

a fourth arm means attached to said third portion of said container means and extending inwardly of said container means for contact with said pipe and whereby movement of said fourth arm means against said pipe when said fourth arm means is in the open position thereof causes said third portion of said container means to move towards said closed position thereof; and wherein said first and second arm means are disposed adjacent to one end of the container and said third and fourth arm means are disposed adjacent to other end of the container means.

6. The apparatus of claim 1 including means for suspending said container means up off the ground.

7. The apparatus of claim 6 including means for attaching a flexible cable to said container means and means for connecting said cable to a derrick above said container means.

8. The apparatus of claim 1 wherein said first and second arm means are respectively rigidly attached to said second and third portions of said container means.

9. The apparatus of claim 8 wherein said third and fourth arm means are respectively rigidly attached to said second and third portions of said container means.

* * * * *